United States Patent [19]

Dang

[11] Patent Number: 4,751,440

[45] Date of Patent: Jun. 14, 1988

[54] ELECTRICAL CONTROL CIRCUIT FOR ISOKINETIC EXERCISE EQUIPMENT

[76] Inventor: Chi H. Dang, 3897 Birchwood Dr., Boulder, Colo. 80302

[21] Appl. No.: 121,172

[22] Filed: Nov. 16, 1987

[51] Int. Cl.[4] ..... A63B 21/24

[52] U.S. Cl. ..... 318/370; 272/129

[58] Field of Search ..... 318/362, 370, 375; 272/116, 125, 129, 93, 130; 128/25 R

[56] References Cited

U.S. PATENT DOCUMENTS 4,060,239 11/1977 Pfleiderer et al. ..... 272/129 X
4,082,267 4/1978 Flavell ..... 272/129 X
4,184,678 1/1980 Flavell et al. ..... 272/129
4,261,562 4/1981 Flavell ..... 272/129
4,358,105 11/1982 Sweeney ..... 272/129 X

*Primary Examiner*—Bentsu Ro

[57] ABSTRACT

An electrical circuit governs the speed and resisting torque of a permanent magnet electric generator which is employed as a means for generating resistance for an isokinetic physical exercise machine to improve the effectiveness of the training. By providing a steep increase of resisting torque to the speed when the torque is below a predetermined value and when the speed exceeds a preset level, it insures a minimum resistance throughout the range of motion and contains the speed within a desired range.

7 Claims, 5 Drawing Sheets

ELECTRICAL CONTROL CIRCUIT FOR ISOKINETIC EXERCISE EQUIPMENT

BACKGROUND OF THE INVENTION

This invention relates to physical exercise equipment, in particular, to a novel electrical circuit which controls the output resistance of an isokinetic strength training device.

An electric generator with an electrical resistive load connected across its two ouput terminals can be used as a means for generating resistance in isokinetic exercise equipments. When the rotation speed of the generator increases, the output voltage and current raise and cause the resisting force to match the user's maximum capacity. As a result, the motion speed is limited by the user's strength. By changing the electrical resistive load, the user can change the speed limit of his motion.

Like most other isokinetic exercise equipments which utilize hydraulic cylinders as a means for generating resistance, the devices employing electric generators also suffer a major draw-back: lacking of resistance at the beginning and the end of each motion. The resistance generated by these devices increases with increasing speed of motion therefore, at the beginning and the end of each exercise repetition where the motion speed is minimal, the resistance is virtually diminished. As a result, the exercise motion does not have the pre-stretch and full range resistance which are necessary for an efficient strength training. The present invention provides a solution for the above short-coming.

SUMMARY OF THE INVENTION AND OBJECTS

The object of the present invention is to provide a simple electrical control circuit for an electrodynamic isokinetic exercise device which improves the training efficiency by furnishing pre-stretch and full range resistance.

The circuit of the present invention creates a very steep increase of resistance with the motion speed when the pulling force is below a preset resistance limit and when the speed exceeds a preset motion speed limit. Therefore, the resistance is always maintained above a minimum level throughout the range of motion. A more detailed understanding of the present invention may be obtained by referring to the drawings and description of the invention.

DESCRIPTION OF THE PREFERRED EMBODIMENT

Figure 1:
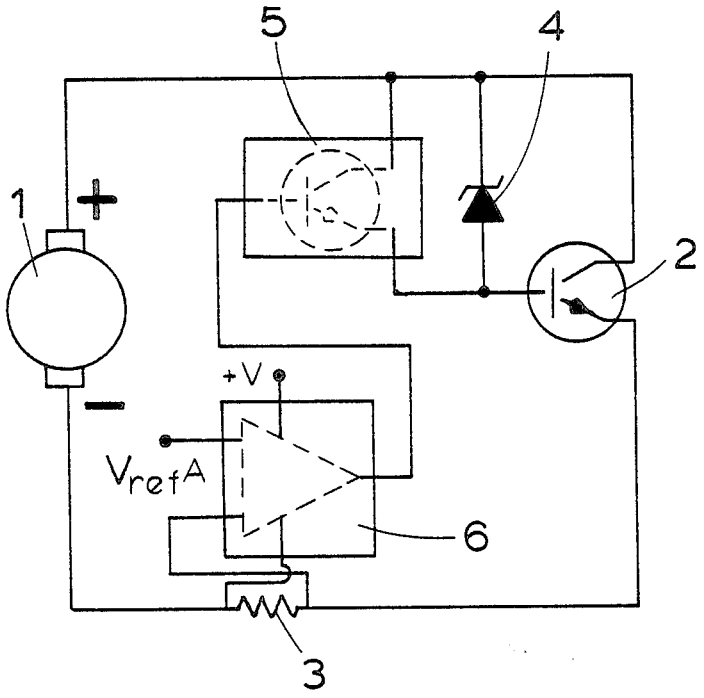
FIG. 1 is a schematic partial illustration of an electrical braking circuit of present invention for governing the resisting torque and rotation speed of an electric generator.

Referring now to FIG. 1, the basic electrical circuit of the present invention comprises: A main transistor 2 which collector is connected to the positive terminal of the generator 1; A current sensing resistor 3 which is placed between the emitter of the main transistor 2 and the negative terminal of the generator 1; An electrical relay 5 which connects the collector of the main transistor 2 to its base; In parallel with the relay 5, a zener diode 4 which has its cathode and its anode respectively connected to the collector and the base of the main transistor 2; A voltage comparing means 6 which compares the voltage across the current sensing resistor 3 with a reference voltage A, and its output voltage which is referred as the triggering signal is fed to the relay 5 to provide the triggering. The voltage comparing means 6 and the relay 5 are configured so that the relay is in the contact mode only when the voltage across the current sensing resistor 3 is smaller than the reference voltage. In the case when the relay 5 is a transistor or a solid state relay and the voltage comparing means 6 is a high gain-operational amplifier, the triggering signal is on if the voltage across the resistor 3 is smaller than the reference, otherwise it is off. The above circuit configuration is one of many possible alternatives derived from the conceptual design of the present invention. For instant, the resistor 3 can be placed between the positive terminal of the generator 1 and the collector of the main transistor 2; However, with this alternative arrangement, the relay 5 cannot be a transistor.

Figure 3:
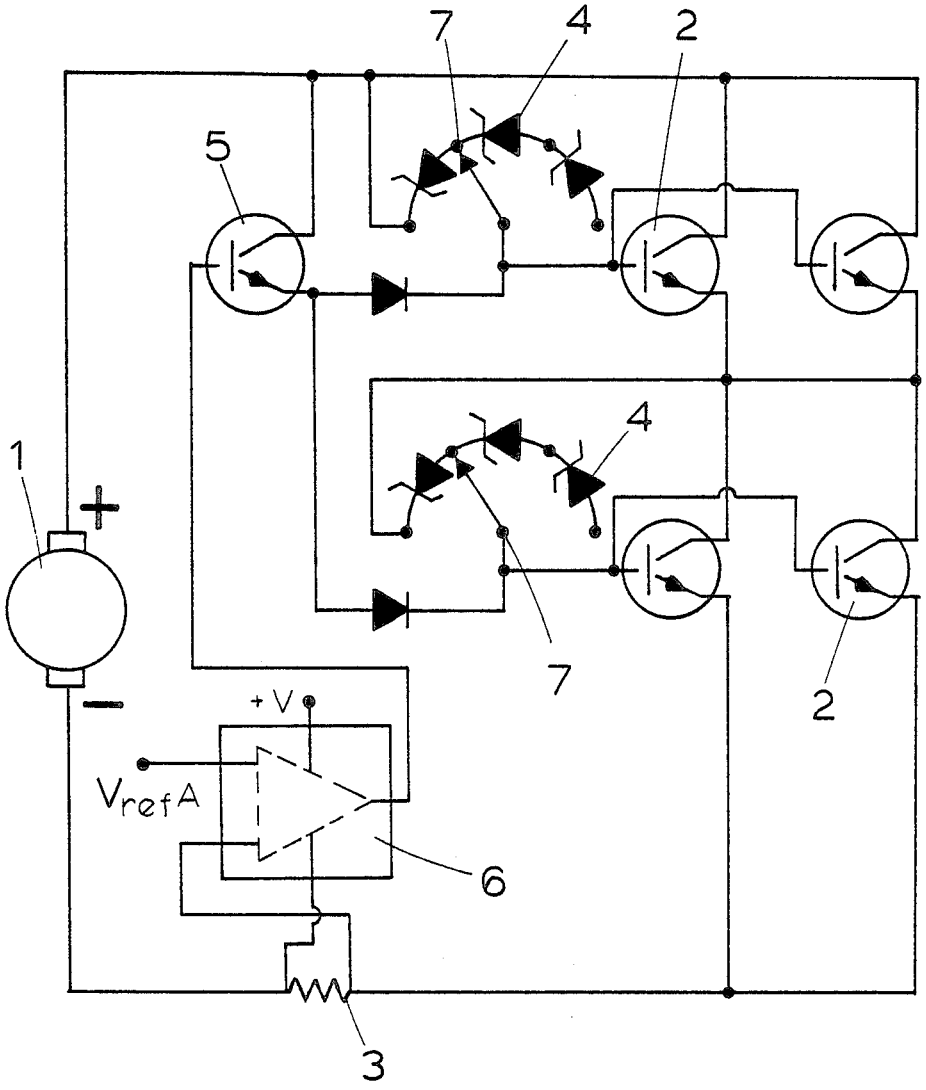
FIG. 3 & FIG. 4 & FIG. 5 are schematic partial illustrations of alternative circuits derived from the present invention.

FIG. 3 illustrates a circuit design in which the main transistors 2 are connected in parallel and serial arrangements to divide the electrical current and voltage across the circuit. With this arrangement, the transistor reliability can be greatly improved since the current carrying capacity of a transistor is substantially higher at lower voltage operation. Also, in this circuit design the zener diode 4 is replaced by an array of zener diodes 4 connected in either parallel or serial arrangement; In combination with the selecting switch 7, the zener diode array can provide variable zener potential.

Figure 2:
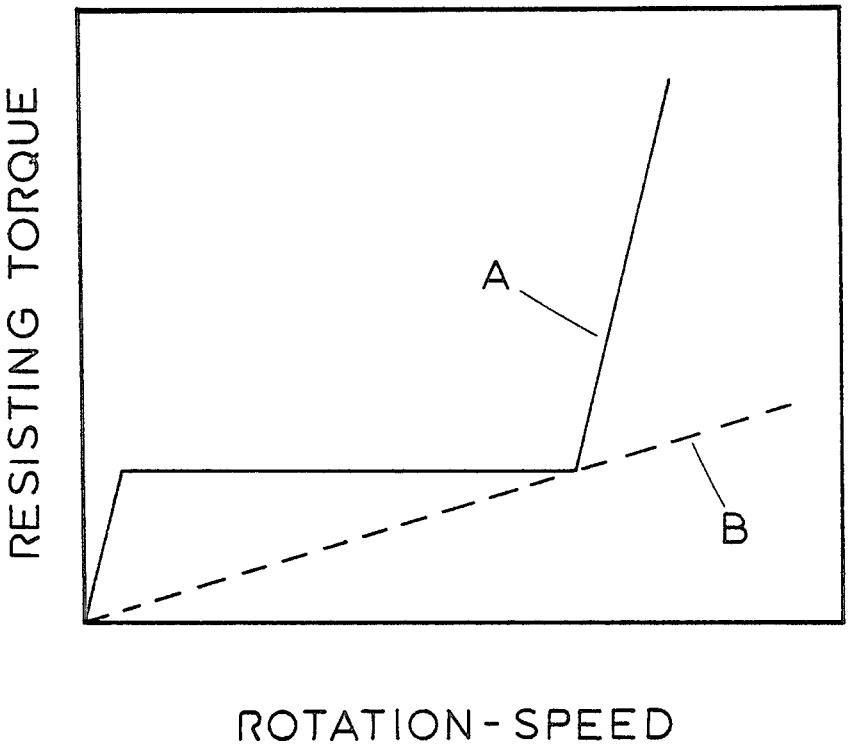
FIG. 2 is a graph showing the responses of the resisting torque to the rotation speed of an electric generator by the braking circuit of the present invention as compare to a simple resistive load.

In operation, the electrical current flowing through the circuit increases steeply with the generator 1 speed until it creates across the current sensing resistor 3 a voltage drop that is larger that the reference voltage A, it remains at that level until the generator 1 reaches a speed which generates a voltage exceeding the zener potential of the zener diode 4, it then has a second steep increase with speed as the speed continues to climb. Since the resisting torque is proportional to the electrical current, the response of torque to speed provided by the braking circuit of the present invention can be illustrated by the curve A in FIG. 2. Also in FIG. 2, the curve B illustrates the response of resisting torque to speed provided by a simple resistive load with a constant electrical resistance.

With the response of torque to speed provided by the electrical circuit of the present invention, the user experiences a predetermined minimum resistance throughout the range of motion, even at the beginning and the end where the speed is small. Furthermore, the steep increase of torque when the speed exceeds a predetermined level keeps the motion speed almost constant while the user is exerting a varying force with his maximum capacity. The predetermined motion speed and minimum resistance limits can be varied by varying the zener potential and the reference voltage A. The triggering signal can also be used to trigger an indication means for advising the user when he has reached the predetermined speed and resistance limits.

Figure 4:
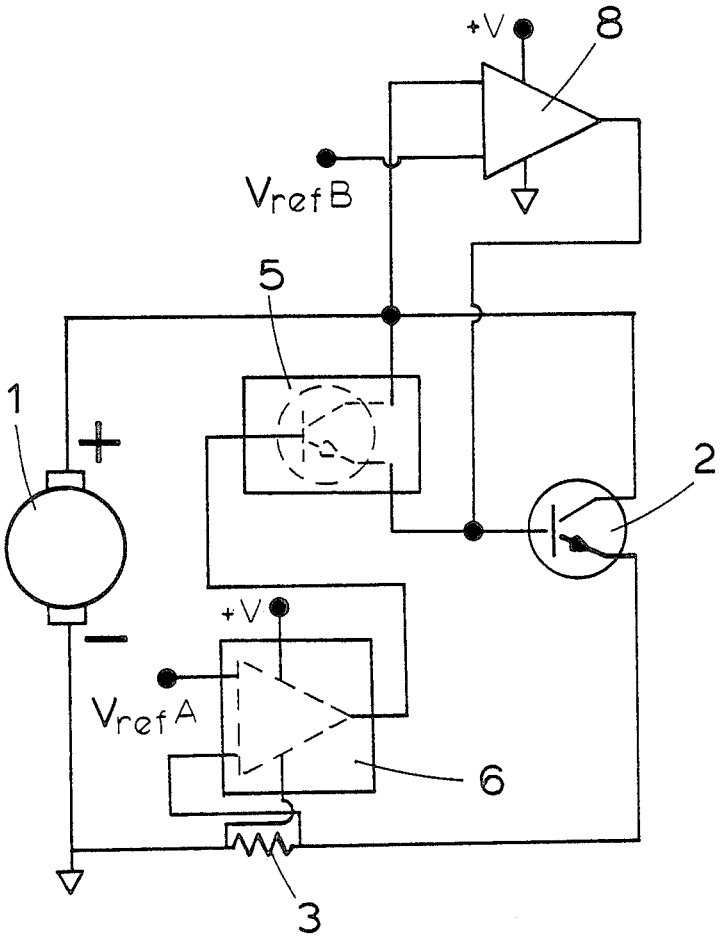

Another alternative approach is illustrated in FIG. 4, wherein the zener diode 4 is replaced by a voltage amplifying means 8 which compares the voltage across the generator 1 with a reference voltage B, its output is then fed to the base of the main transistor 2. This arrangement must be configured so that the main transistor 2 starts to conduct current when the voltage across the generator 1 exceeds the reference voltage B which determines the motion speed limit. To gain much steeper increase of resistance with speed when the speed exceeds the predetermined level, the voltage amplifying means 8 can be a voltage comparing means or a very high gain-operational amplifier.

Figure 5:
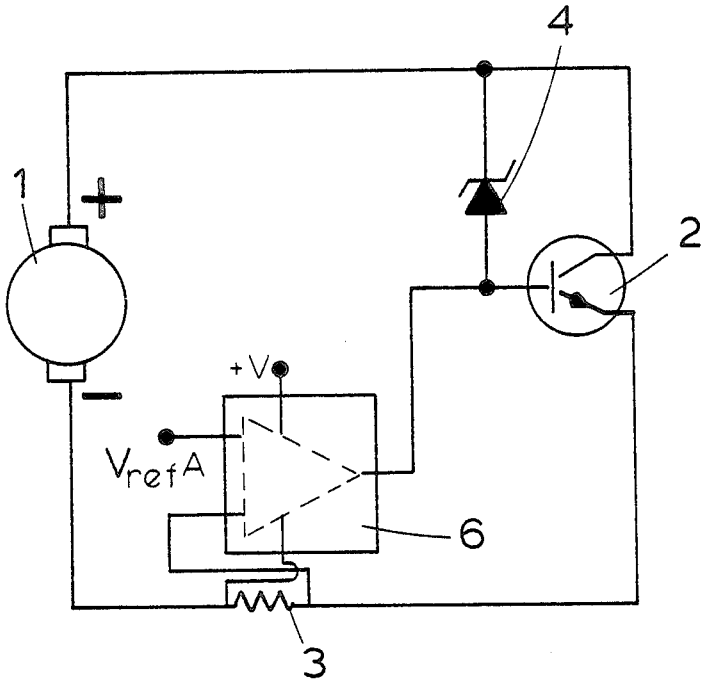

FIG. 5 illustrates another alternative design wherein the electrical relay 5 is removed and the triggering signal is fed directly to the base of the main transistor 2.

Having described and disclosed my invention, I claim:

1. An electrical controller for governing the speed and torque of a permanent magnet electric generator, comprising:

an electrical loading means with variable and controllable conductivity connected to the output terminals of the generator;

a speed control feedback means connected to said electrical loading means for controlling the conductivity of said electrical loading means; said speed control feedback means comprises a voltage comparing means for comparing the generator voltage with a predetermined voltage setting; said voltage comparing means causes said electrical loading means to increase conductivity when the generator speed exceeds a predetermined speed setting and to remain at a predetermined least conductive state when the generator speed is below said predetermined speed setting;

a torque control feedback means connected to said electrical loading means for controlling the conductivity of said electrical loading means; said torque control feedback means comprises a means for detecting a resisting torque generated by the generator and a voltage comparing means for comparing the detected resisting torque with a predetermined torque setting; said voltage comparing means causes said electrical loading means to decrease conductivity when the generator torque exceeds said predetermined torque setting and to remain at the most conductive state when the generator torque is below said predetermined torque setting; and wherein the conductivity of said electrical loading means is a function of the sum of conductivity caused by said speed control feedback means and said torque control feedback means.

2. The electrical controller of claim 1, wherein said electrical loading means comprises a power semiconductor means.

3. The electrical controller of claim 2, wherein said power semiconductor means comprises a set of power transistors.

4. The electrical controller of claim 3, wherein the voltage comparing means of said speed control feedback means comprises a comparator for comparing the electrical potential difference between the output terminals of the generator which increases proportionally with the generator speed, with said predetemined voltage setting, said predetermined voltage setting determines said predetermined speed setting.

5. The electrical controller of claim 3, wherein the voltage comparing means of said speed control feedback means comprises a zener diode network with variable zener potential, cathode of said zener diode network connected to collectors of said power transistors, anode of said zener diode network connected to bases of said power transistors.

6. The electrical controller of claim 3, wherein said resisting torque detecting means comprises an electrical current sensing means for sensing the electrical current flowing through the generator which increases proportionally with the resisting torque, and wherein said voltage comparing means of said torque control feedback means comprises a comparator for comparing the output voltage from said electrical current sensing means with a reference voltage, said reference voltage determines said predetermined torque setting.

7. The electrical controller of claim 6, wherein said electrical current sensing means comprises a resistor connecting said electrical loading means to a generator output terminal, the electrical potential difference across said resistor determines electrical current flowing through said generator.

* * * * *